US005865436A

United States Patent [19]

Conti

[11] Patent Number: 5,865,436

[45] Date of Patent: Feb. 2, 1999

[54] THEMED BOARD GAME

[76] Inventor: Aparecida Conti, 192 F Dunsdon Street, Brantford, Ontario, Canada, N3R6K2

[21] Appl. No.: 891,106

[22] Filed: Jul. 10, 1997

[51] Int. Cl.[6] ..... A63F 3/00

[52] U.S. Cl. ..... 273/241

[58] Field of Search ..... 273/241, 242, 273/243, 260, 261

[56] References Cited

U.S. PATENT DOCUMENTS

| | | | |
|---|---|---|---|
| D. 242,271 | 11/1976 | Harvey | 273/241 X |
| D. 248,785 | 8/1978 | Haber | D34/5 CH |
| D. 249,288 | 9/1978 | Hodkin | D34/5 CH |
| D. 266,012 | 8/1982 | Shyu | D21/52 |
| D. 267,257 | 12/1982 | Peraino | D21/52 |
| 3,608,904 | 9/1971 | Margetson | 273/137 R |
| 3,759,523 | 9/1973 | Randolph | 273/137 R |
| 3,881,731 | 5/1975 | Droney | 273/137 R |
| 4,067,578 | 1/1978 | Chang | 273/261 |
| 4,319,754 | 3/1982 | Yaworsky | 273/241 |
| 5,249,805 | 10/1993 | Neil et al. | 273/241 X |
| 5,443,268 | 8/1995 | Mayfield et al. | 273/241 |
| 5,678,819 | 10/1997 | Underwood | 273/241 |

FOREIGN PATENT DOCUMENTS

| | | | |
|---|---|---|---|
| 2592809 | 7/1987 | France | 273/241 |
| 2230460 | 3/1979 | Germany | 273/241 |
| 9421342 | 9/1994 | WIPO | 273/241 |

*Primary Examiner*—William E. Stoll
*Attorney, Agent, or Firm*—David L. Volk

[57] ABSTRACT

A playing piece includes a base and an ornamental attachment. At least one aperture within the base is configured to snugly receive a pin within, such that a distal end of the pin extends beyond a top surface of the base. The ornamental attachment includes at least one receiving hole configured to snugly receive the distal end of the pin therein, thereby firmly affixing the ornamental attachment to the base. A game board includes a substantially transparent first panel having a gaming area marked thereon for resting the playing piece thereon, the first panel being substantially transparent. An ornamental structure is configured for attachment to the first panel such that at least a portion of the ornamental structure is disposed below the first panel a pre-determined distance away from the first panel when the game board is positioned in an upright position and ready for playing thereon, and the ornamental structure is viewable through the first panel.

9 Claims, 6 Drawing Sheets

THEMED BOARD GAME

BACKGROUND OF THE INVENTION

1. Field of the Invention

The present invention relates to games, particularly to board games.

2. Description of the Related Art

In the prior art, there has not been a board game with the visually appealing 3-dimensional effect of the present invention; nor has there been a board game with the conveniently interchangeable elements of the present invention.

SUMMARY OF THE INVENTION

The themed board game of the present invention includes a plurality of playing pieces and a game board. Each playing piece includes a base and an ornamental attachment. At least one aperture within the base is configured to snugly receive a pin within, such that a distal end of the pin extends beyond a top surface of the base. The ornamental attachment includes at least one receiving hole configured to snugly receive the distal end of the pin therein, thereby firmly affixing the ornamental attachment to the base. A game board includes a substantially transparent first panel having a gaming area marked thereon for resting the playing piece thereon, the first panel being substantially transparent. An ornamental structure is configured for attachment to the first panel such that the ornamental structure is disposed below the first panel when the game board is positioned in an upright position and ready for playing thereon, and the ornamental structure is viewable through the first panel. The ornamental structure may resemble a sport stadium, arena or ball park having a playing field and spectator seating. Ornamental structure based on other themes is possible, including but not limited to history, military, space, television and movies.

Still further features and advantages will become apparent from the ensuing description and drawings.

DETAILED DESCRIPTION

Figure 1:
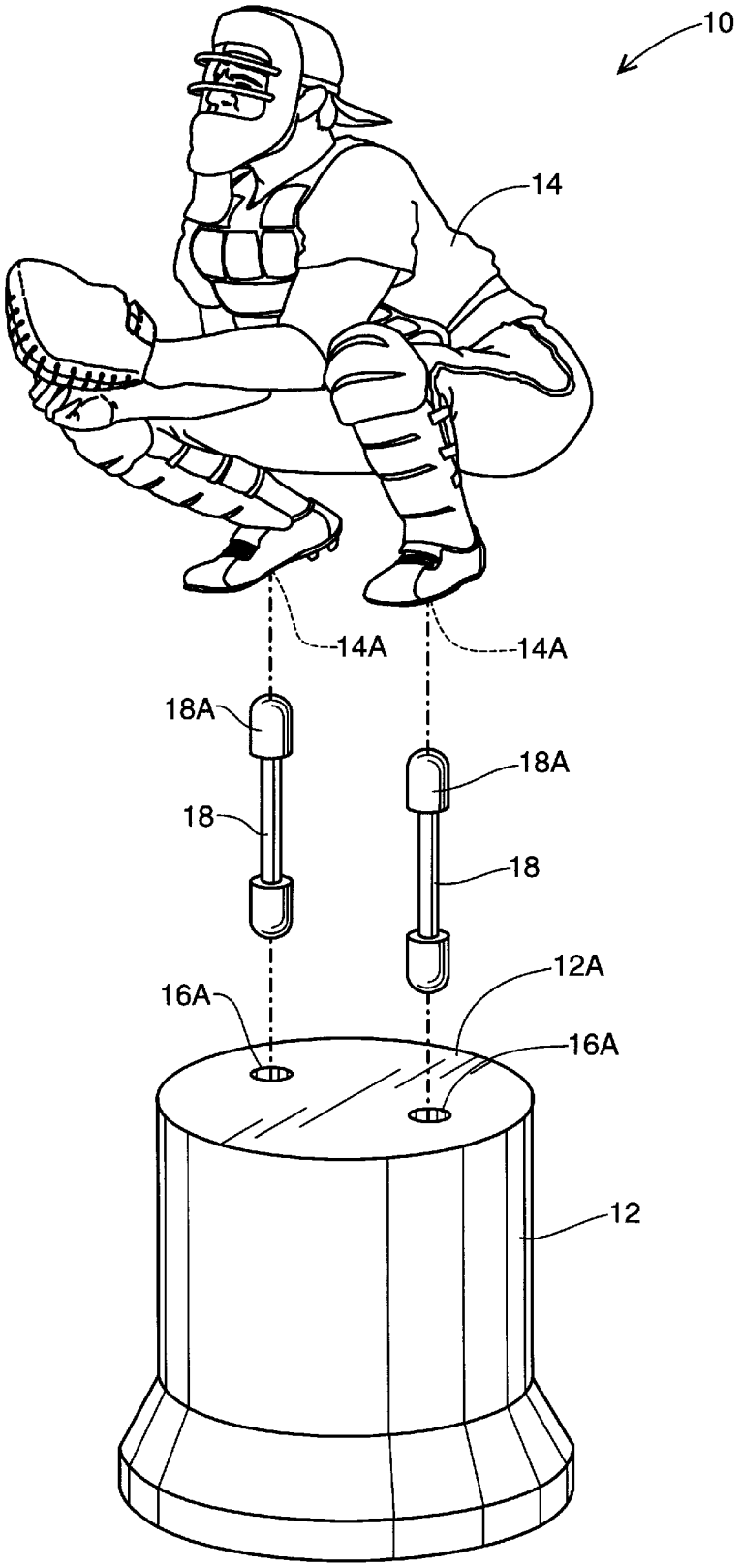
FIG. 1 is an exploded perspective view of a playing piece.

FIG. 1 is an exploded perspective view of a playing piece 10 including a base 12 and an ornamental attachment 14. As shown, the ornamental attachment 14 resembles a baseball player, specifically a catcher. The ornamental attachment 14 may be any type of sports figure, or even be based on other themes including but not limited to space, television, movies, history and military. For example, the ornamental attachment 14 may be made to resemble a football player, a soldier, or a space ship.

Also as shown, the playing piece 10 would be suitable as a chess piece. The playing piece 10 may also be adapted as a checker, or as a playing piece for a virtually unlimited number of possible games.

Figure 2:
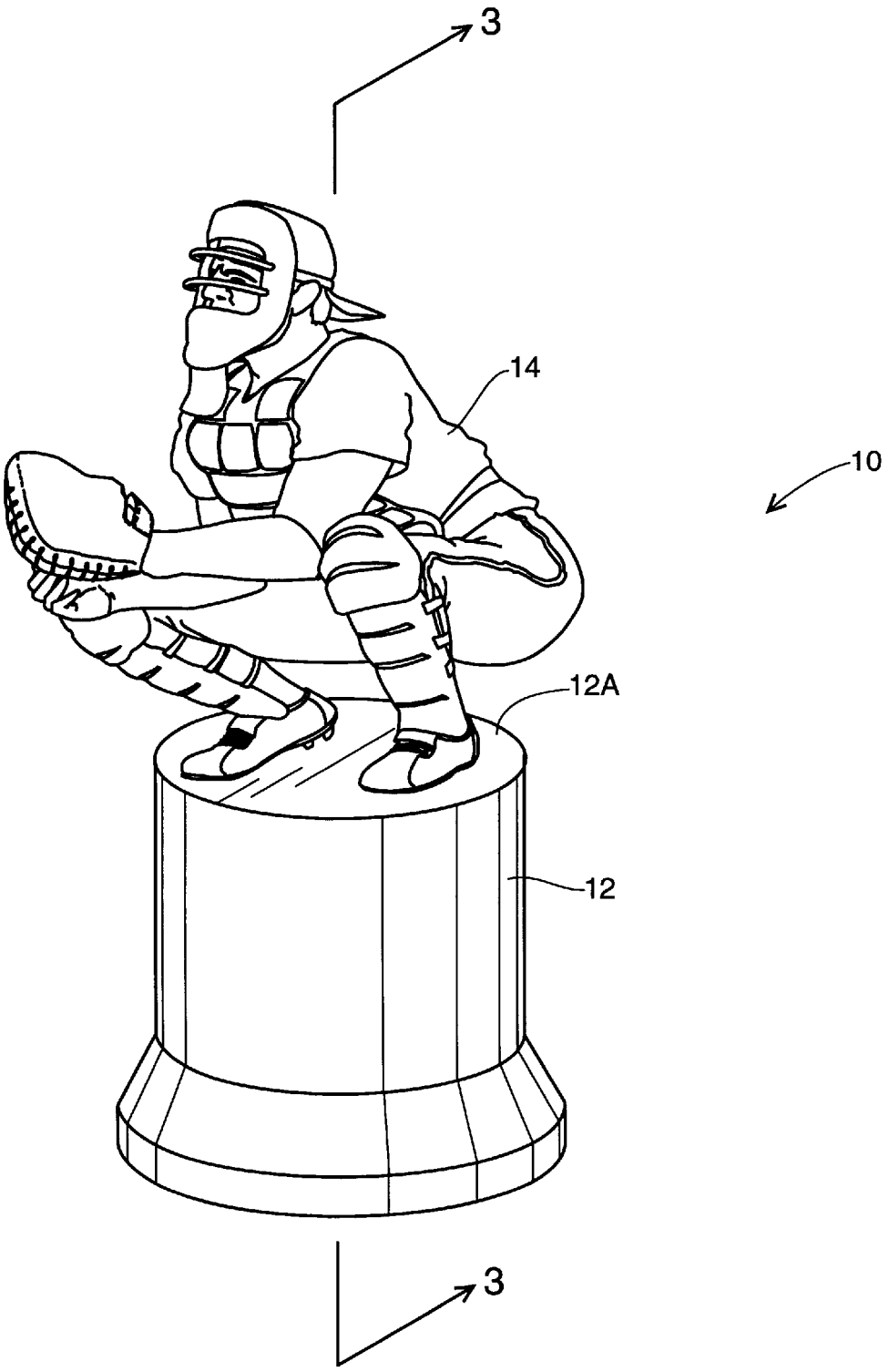
FIG. 2 is a perspective view of the assembled playing piece.
Figure 3:
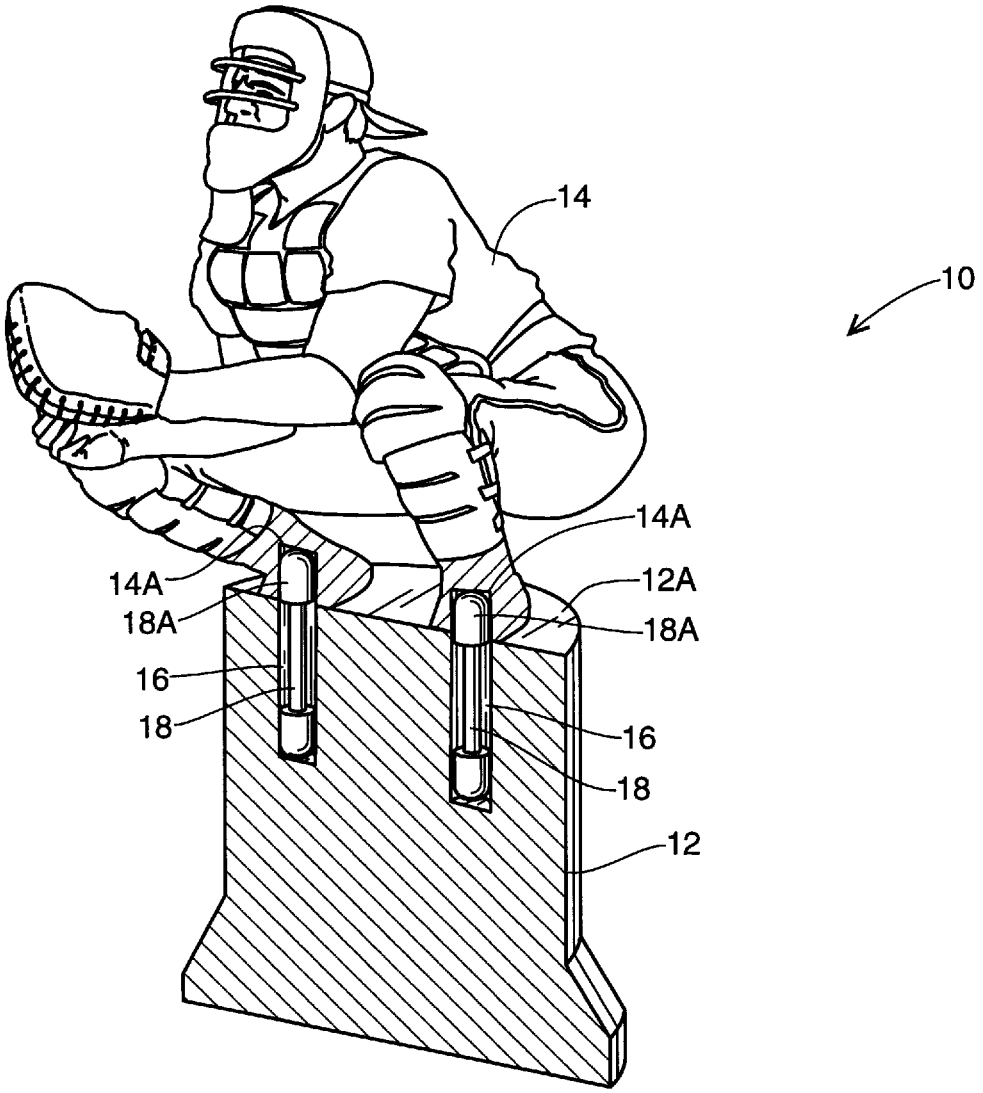
FIG. 3 is a cross-sectional view of the playing piece taken along line 3—3 of FIG. 2.

FIG. 2 is a perspective view of the playing piece 10 with the ornamental attachment 14 attached to the base 12, and FIG. 3 is a cross-sectional view of the playing piece 10 taken along line 3—3 of FIG. 2. Referring to FIGS. 1, 2 and 3, the base 12 includes structure forming at least one elongated aperture 16 therein. Each aperture 16 is oriented vertically within the base 12 when the base 12 is in an upright position. Each aperture 16 includes a top opening 16A at a top surface 12A of the base 12. A pin 18 is configured to snugly fit within each of the apertures 16 such that a distal end 18A of the pin 18 extends partially beyond the top surface 12A of the base 12.

The ornamental attachment 14 includes at least one receiving hole 14A configured to snugly receive the distal end 18A of the pin 18 therein, thereby firmly affixing the ornamental attachment 14 to the base 12.

Figure 4:
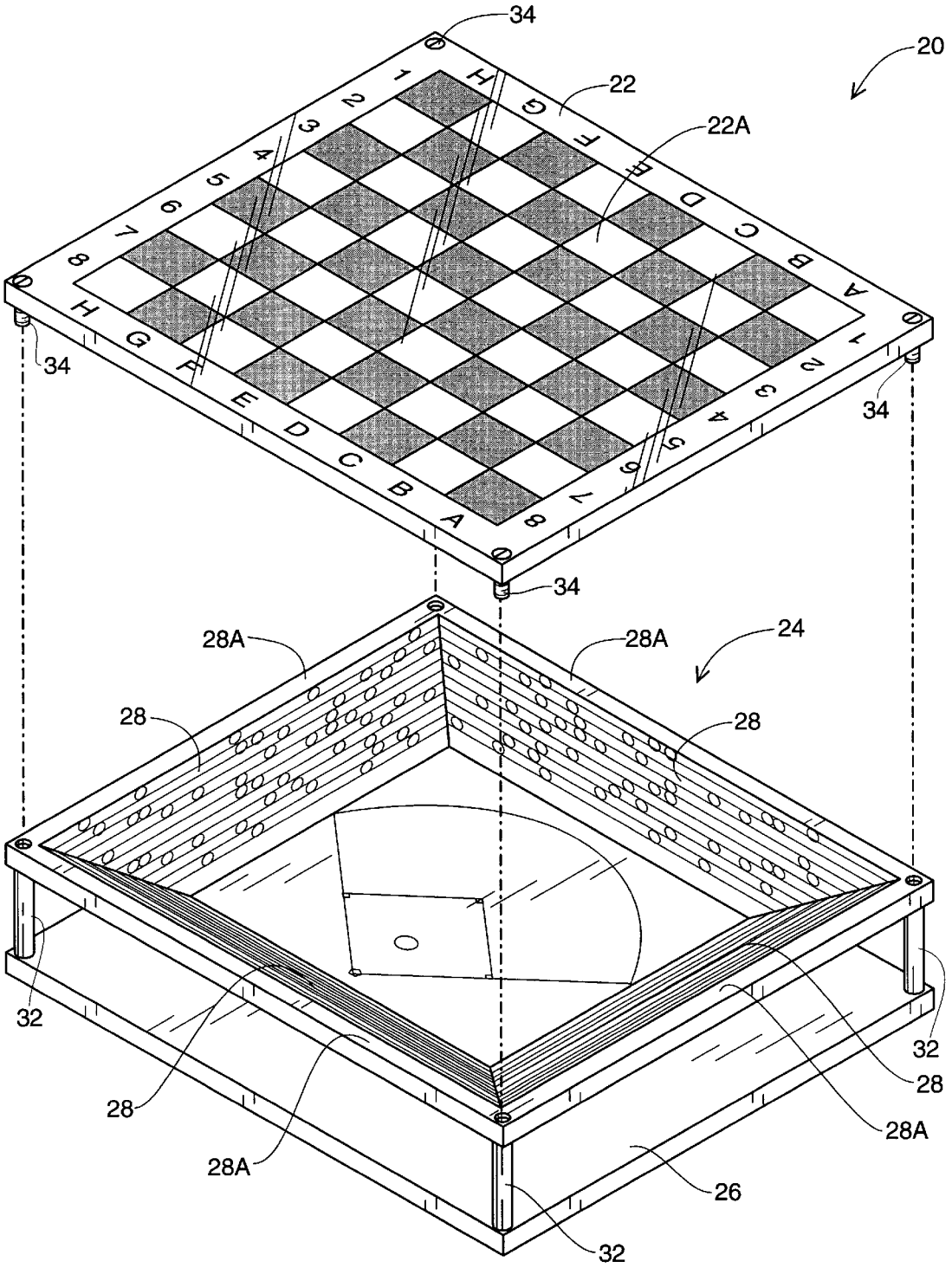
FIG. 4 is an exploded perspective view of a game board.

FIG. 4 is an exploded perspective view of a game board 20 for use with the playing piece 10, or for use with any suitable playing piece. The game board 20 includes a first panel 22 having a gaming area 22A marked thereon for resting the playing pieces 10 thereon. As shown the gaming area 22A is a chess or checker gaming area; however, any type of gaming area is possible. For example, and not by way of limitation, the gaming area 22A could be adapted for backgammon.

The game board 20 further includes an ornamental structure 24, which is configured for attachment to the first panel 22 such that the ornamental structure 24 is disposed below the first panel 22 when the game board 20 is positioned in an upright position and ready for playing thereon. The ornamental structure 24 includes a second panel 26 adapted to rest on a flat surface such as a table (not shown) when the game board 20 is in an upright position as shown.

The ornamental structure 24 further includes a plurality of third panels 28 extending angularly upward and outward from the second panel 26 when the game board 20 is in an upright position. The third panels 28 are configured for attachment to the first panel 22 substantially at upper edges 28A of the third panels 28, thus maintaining the second panel 26 a predetermined distance away from the first panel 22. Columns 32 extend between the third panels 28 and the second panel 26.

As shown, the first panel 22 includes self-tapping screws 34 configured to threadedly engage the third panels 28. Any known means for attaching the first panel 22 to the ornamental structure 24 is within the scope of the present invention.

As shown, the second panel 26 includes markings representing a baseball playing field thereon. Alternatively, the second panel 26 may be shaped or marked to represent any type of sports field, or scenery based on any theme. For example, and not by way of limitation, the second panel 26 may represent a football field, a battlefield, or an airplane hangar.

As shown, the third panels 28 include markings thereon representing spectator seating, and the positioning and configuration of the third panels 28 suggests a stadium structure. The columns 32 enhance the stadium effect. Alternately, the third panels 28 may be shaped or marked thereon to represent mountains, a sky, a city skyline, a horizon, or any other suitable themed scenery.

Figure 5:
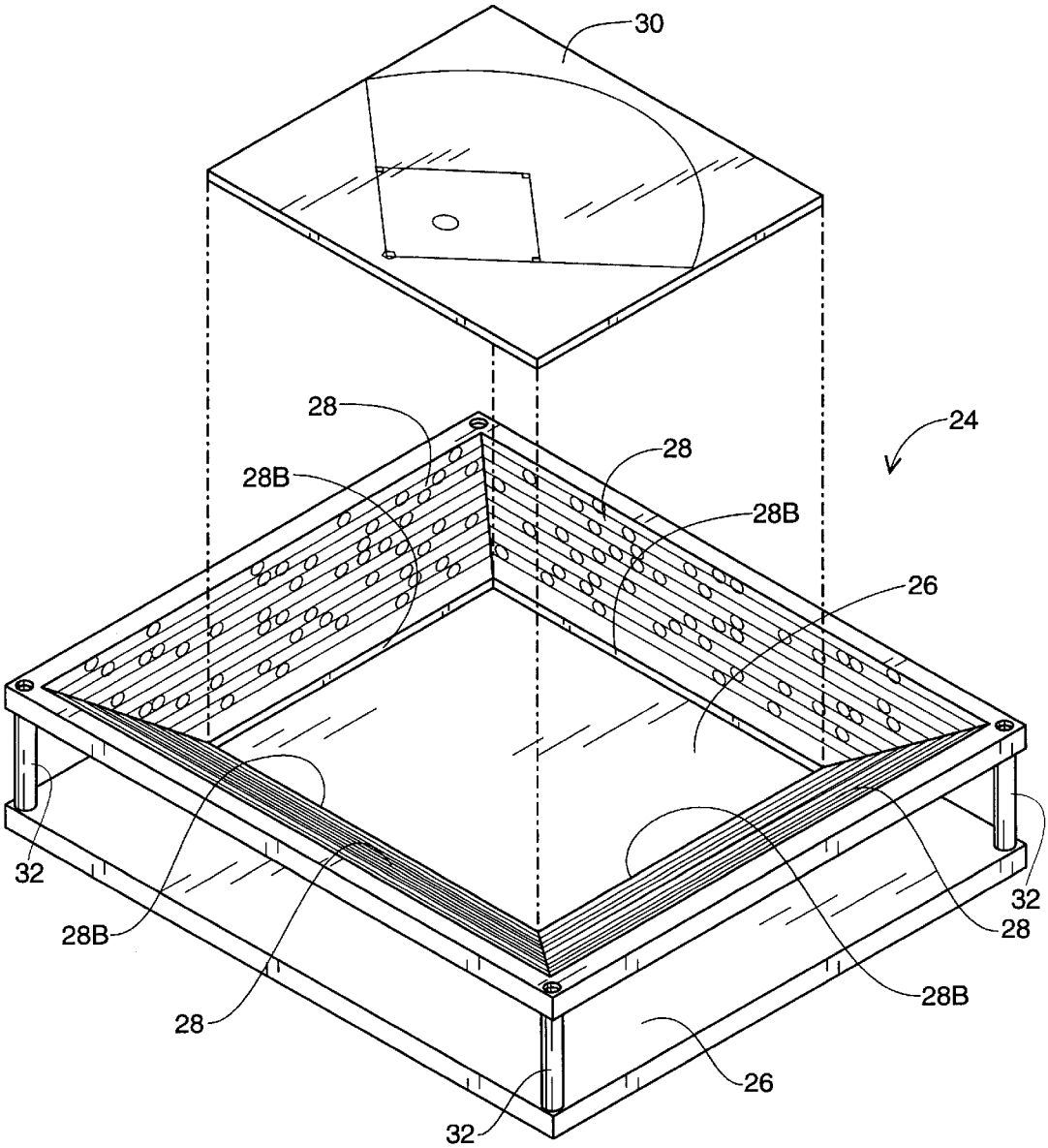
FIG. 5 is an exploded perspective view of another embodiment of the ornamental structure.

FIG. 5 is an exploded perspective view of another embodiment of the ornamental structure 24. In this embodiment, an interchangeable fourth panel 30 is marked or shaped to represent themed scenery, instead of marking or shaping the second panel 26 in such a manner. The fourth panel 30 is configured to rest on the second panel 26 between lower edges 28B of the third panels 28 when the ornamental structure 24 is in an upright position.

Figure 6:
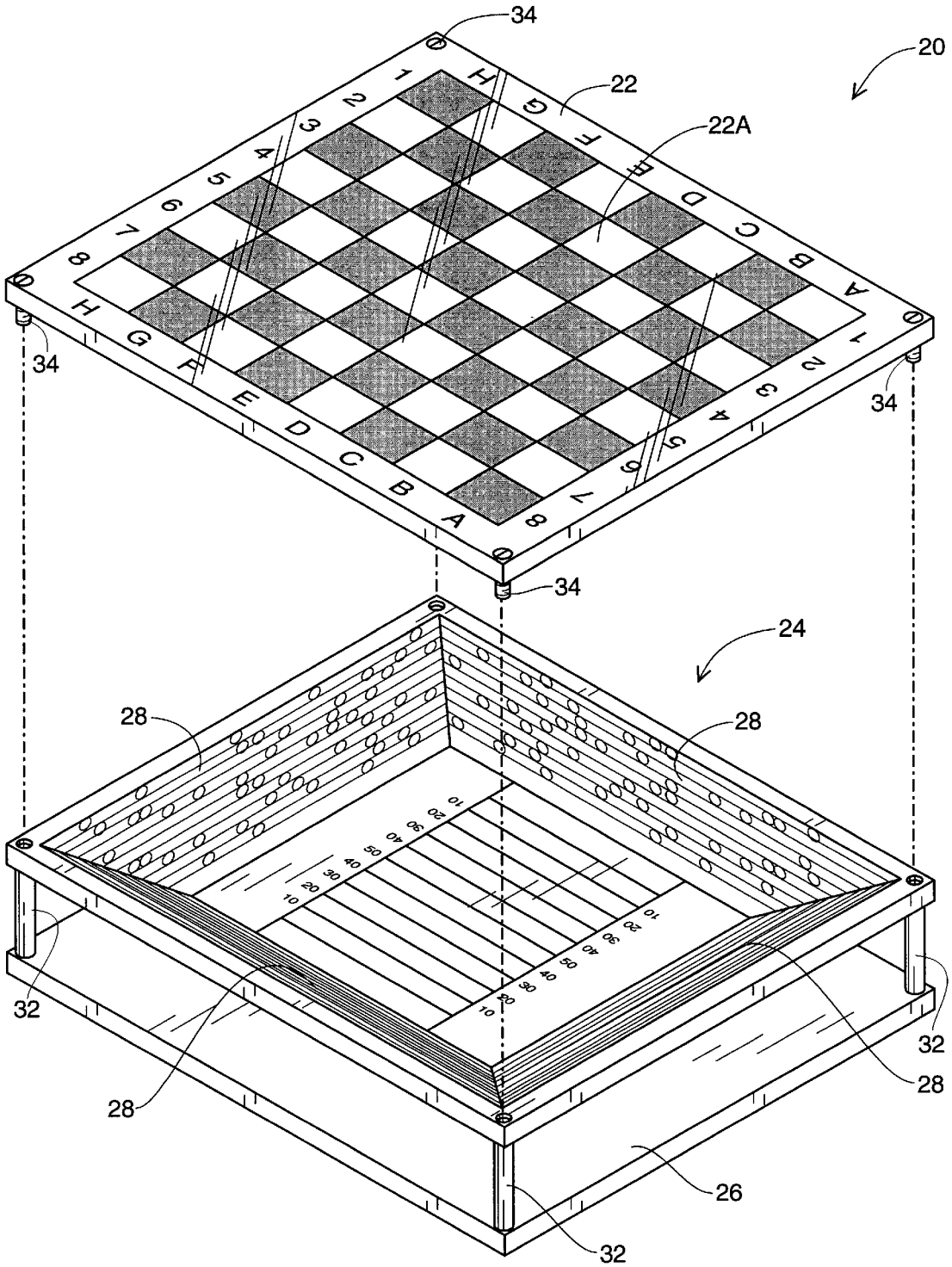
FIG. 6 is an exploded perspective view of another embodiment of a game board.

FIG. 6 is an exploded perspective view of the game board 20, wherein the ornamental structure 24 represents a football stadium and field. This is shown as one of many examples of the various embodiments possible for the present invention.

The foregoing description is included to describe embodiments of the present invention which include the preferred embodiment, and is not meant to limit the scope of the invention. From the foregoing description, many variations will be apparent to those skilled in the art that would be encompassed by the spirit and scope of the invention. Accordingly, the scope of the invention is to be limited only by the following claims and their legal equivalents.

The invention claimed is:

1. A game board for use with playing pieces, the game board comprising:

a. a first panel having a gaming area marked thereon for resting the playing pieces thereon, the first panel being substantially translucent;

b. an ornamental structure configured for attachment to the first panel such that at least a portion of the ornamental structure is disposed below the first panel a pre-determined distance away from the first panel when the game board is positioned in an upright position and ready for playing thereon, and the ornamental structure is viewable through the first panel;

c. the ornamental structure comprising a second panel adapted to rest on a flat surface when the game board is in an upright position; and d. the ornamental structure further comprising at least one third panel extending angularly upward and outward from the second panel when the game board is in an upright position.

2. The game board of claim 1, wherein the third panel is configured to attach to the first panel substantially at an upper edge of the third panel.

3. The game board of claim 1, wherein the ornamental structure further comprises a fourth panel configured to rest on the second panel substantially at a lower edge of the third panel when the game board is in an upright position.

4. The game board of claim 3, wherein the fourth panel is interchangeable.

5. The game board of claim 1, wherein the second panel is configured to represent a sports playing field, and the third panel is configured to represent spectator seating.

6. The game board of claim 5, wherein the sports playing field is a baseball playing field.

7. The game board of claim 5, wherein the sports playing field is a football playing field.

8. A game board for use with playing pieces, the game board comprising:

a. a first panel having a gaming area marked thereon for resting the playing pieces thereon, the first panel being substantially translucent; and b. an ornamental structure configured for attachment to the first panel such that the ornamental structure is disposed below the first panel when the game board is positioned in an upright position and ready for playing thereon, and the ornamental structure is viewable through the first panel;

c. the ornamental structure comprising a second panel adapted to rest on a flat surface when the game board is in an upright position;

d. the ornamental structure further comprising a plurality of third panels extending angularly upward and outward from the second panel when the game board is in an upright position, the third panels configured for attachment to the first panel substantially at upper edges of the third panels;

e. the ornamental structure further comprising an interchangeable fourth panel configured to rest on the second panel between lower edges of the third panels when the game board is in an upright position;

f. the second panel being configured to represent a playing field; and g. the third panel being configured to represent spectator seating.

9. The game board of claim 8, wherein the ornamental structure further comprises columns extending between the third panels and the second panel.

* * * * *